US009633608B2

(12) United States Patent
Shin

(10) Patent No.: US 9,633,608 B2
(45) Date of Patent: Apr. 25, 2017

(54) DISPLAY DEVICE HAVING A PLURALITY OF REGIONS AND METHOD OF DRIVING THE SAME AT DIFFERENT OF FREQUENCIES

(71) Applicant: Samsung Display Co. Ltd., Yongin, Gyeonggi-Do (KR)

(72) Inventor: Yong Hwan Shin, Yongin-si (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 201 days.

(21) Appl. No.: 14/249,141

(22) Filed: Apr. 9, 2014

(65) Prior Publication Data

US 2015/0170607 A1 Jun. 18, 2015

(30) Foreign Application Priority Data

Dec. 16, 2013 (KR) ..... 10-2013-0156487

(51) Int. Cl.

| | |
|---|---|
| ***G09G 5/10*** | (2006.01) |
| ***G09G 3/34*** | (2006.01) |
| ***G09G 3/20*** | (2006.01) |
| *G09G 3/3225* | (2016.01) |
| *G09G 3/36* | (2006.01) |

(52) U.S. Cl.

CPC ..... *G09G 3/3406* (2013.01); *G09G 3/20* (2013.01); *G09G 3/3225* (2013.01); *G09G 3/344* (2013.01); *G09G 3/3648* (2013.01); *G09G 2320/064* (2013.01); *G09G 2320/0626* (2013.01); *G09G 2330/022* (2013.01)

(58) Field of Classification Search

CPC ..... G09G 3/3406; G09G 3/20; G09G 3/3225; G09G 3/344; G09G 3/3648; G09G 2320/0626; G09G 2320/064; G09G 2330/022

See application file for complete search history.

(56) References Cited

U.S. PATENT DOCUMENTS 6,980,225 B2 12/2005 Funamoto et al.
7,460,103 B2 * 12/2008 Konno ..... G09G 3/3426 345/102
7,710,377 B2 5/2010 Kang et al.
(Continued)

FOREIGN PATENT DOCUMENTS

KR 10-0560489 B1 3/2006
KR 10-2007-0078141 A 7/2007
(Continued)

*Primary Examiner* — Lun-Yi Lao
*Assistant Examiner* — Elliott Deaderick
(74) *Attorney, Agent, or Firm* — Knobbe, Martens, Olson & Bear, LLP

(57) ABSTRACT

In one aspect, the display device includes a display panel including a first region and a second region, wherein the first region is configured to display a first image having a first luminance and wherein the second region is configured to display a second image having a second luminance. The display device also includes a panel driver configured to drive the first region at a first frequency and the second region at a second frequency less than the first frequency and a luminance compensator configured to compensate for the difference between the first and second luminances.

13 Claims, 16 Drawing Sheets

(56) References Cited

U.S. PATENT DOCUMENTS 7,764,252 B2* 7/2010 Miller ..... G09G 3/3233 345/77
8,401,326 B2 3/2013 Chen et al.
2005/0140631 A1* 6/2005 Oh ..... G09G 3/3406 345/89
2008/0284719 A1* 11/2008 Yoshida ..... G02F 1/136277 345/102
2009/0167957 A1* 7/2009 Joo ..... G09G 5/00 348/687
2009/0327777 A1* 12/2009 Vasquez ..... G09G 3/3611 713/320
2011/0115826 A1* 5/2011 Fujiwara ..... G09G 3/3426 345/690
2011/0227966 A1 9/2011 Mori
2011/0261293 A1* 10/2011 Kimura ..... G02F 1/13624 349/74
2012/0092388 A1* 4/2012 Kamon ..... G09G 3/3426 345/690
2012/0162159 A1 6/2012 Kim et al.
2013/0076769 A1 3/2013 Park et al.
2014/0028657 A1* 1/2014 Kobayashi ..... G09G 3/3648 345/212
2014/0176626 A1* 6/2014 Sasaki ..... G09G 3/2051 345/697
2014/0320479 A1* 10/2014 Kaneko ..... G09G 3/3688 345/212

FOREIGN PATENT DOCUMENTS

KR 10-2008-0026718 A 3/2008
KR 10-2008-0048716 A 6/2008
KR 10-2013-0018493 A 2/2013

* cited by examiner

DISPLAY DEVICE HAVING A PLURALITY OF REGIONS AND METHOD OF DRIVING THE SAME AT DIFFERENT OF FREQUENCIES

CROSS-REFERENCE TO RELATED APPLICATIONS

This application claims priority from Korean Patent Application No. 10-2013-0156487 filed on Dec. 16, 2013 in the Korean Intellectual Property Office, the disclosure of which is incorporated herein by reference in its entirety.

BACKGROUND

Field

The described technology generally relates to a display device and a method of driving the same.

Description of the Related Technology

Display devices include a display panel on which images are displayed and a driving unit which drives the display panel. Examples of display panels include liquid crystal display (LCD) panels, organic light-emitting diode (OLED) display panels, plasma display panels (PDPs), and an electrophoretic display (EPD) panels.

Display panels can display either still or moving images. Display panels can be driven at a frame rate of several frames per second. When a number of sequential frames display the same image data, a still image is displayed. Additionally, when sequential frames display different image data, a moving image is displayed. The standard display panel is driven at a frequency of about 60 Hz. Alternatively, display panels can be driven at frequencies higher than about 60 Hz in order to display high quality moving images. In order to reduce power consumption when displaying a still image, display panels can also be driven at lower frequencies of about 30 Hz or about 15 Hz. That is, display panels can be driven at various frequencies depending on whether a still image or a moving image is displayed.

SUMMARY OF CERTAIN INVENTIVE ASPECTS

One inventive aspect is a display device which can compensate for the difference in luminances between a moving-image region and a still-image region so as to substantially prevent the boundary between the two regions from being visible.

Another aspect is a method of driving the display device.

According to at least one embodiment, it is possible to compensate for the difference in luminances between a moving-image region and a still-image region and thus substantially prevent the boundary between the two regions from being visible.

Another aspect is a display device including a display panel including a first region driven at a first frequency and a second region driven at a second frequency that is lower than the first frequency, a panel driver configured to drive the display panel and a luminance compensator configured to compensate for a difference between luminance of the first region and luminance of the second region.

The luminance compensator is further configured to correct one or more data voltages applied to the first region to correspond to one or more data voltages that are discharged in the second region.

The luminance compensator is further configured to lower the data voltages applied to the first region such that an average of the data voltages applied to the first region becomes substantially identical to an average of the data voltages applied to the second region.

The display device may further include a memory configured to store a plurality of lookup tables (LUTs) in which correction data for the first region is stored in the form of a matrix.

The display device may further include a luminance measurement unit configured to measure luminance of the display panel and output a luminance signal corresponding to the measured luminance to the timing control unit, the luminance compensator is further configured to control the first region and the second region to have substantially the same luminance according to the luminance signal.

The display device may further include a light source unit configured to provide light to the display panel and a light source driving unit configured to control the light source unit, wherein the luminance compensator is further configured to provide a light source control signal having a waveform that is symmetrical with the waveform of the luminance signal to the light source driving unit and the light source driving unit is further configured to drive the light source unit according to the light source control signal.

The display device may further include an image controller configured to compare image data of a current frame and image data of a previous frame and thus to set the first region and the second region in the display panel.

The first region includes a moving-image display region and the second region includes a still-image display region.

The first frequency is about 60 Hz and the second frequency is about 20 Hz.

Another aspect is a display device including a plurality of pixels comprising a first pixel group and a second pixel group, wherein the first pixel group is configured to display a first image having a first luminance and wherein the second pixel group is configured to display a second image having a second luminance, a plurality of scan lines electrically connected to the pixels, a plurality of data lines crossing the scan lines and electrically connected to the pixels, a scan driver configured to respectively apply a plurality of scan signals to the scan lines and drive the first pixel group at a first frequency and the second pixel group at a second frequency, a data driver configured to respectively apply a plurality of data voltages to the data lines and a luminance compensator configured to compensate for the difference between the first and second luminances.

The luminance compensator is further configured to respectively apply first and second data voltages to the first and second pixel groups and wherein the luminance compensator is further configured to lower one or more of the first data voltages over a single frame period such that the average of the first data voltages is substantially the same as the average of the second data voltages applied to the second pixel group.

The display device further includes a light source configured to provide light to the pixels, wherein the luminance compensator is further configured to increase luminance of the light source based at least in part on a decrease in the second luminance.

at least one of the pixels in the first pixel group is configured to display a moving-image and wherein at least one of the pixels in the second pixel group is configured to display a still-image.

The first frequency is about 60 Hz and the second frequency is about 20 Hz.

The display device further comprises an image controller configured to: receive present frame image data and previous frame image data, compare the present frame image data to the previous frame image data and set the first pixel group and the second pixel group based at least in part on the comparison.

Another aspect is a method of driving a display device including a display panel including a first region and a second region, the method comprising displaying a first image having a first luminance in the first region, displaying a second image having a second luminance in the second region, driving the first region at a first frequency and the second region at a second frequency, compensating image data for the difference between the first and second luminances, converting the compensated image data into data voltages and applying the data voltages to the display panel.

The compensating comprises lowering one or more of the first data voltages over a single frame period such that the average of the first data voltages applied is substantially the same as the average of the second data voltages.

The display device further comprises a light source, wherein the method further comprises the light source providing light to the display panel, and wherein the compensating comprises increasing luminance of the light source based at least in part on a decrease in the luminance of the second region.

The first frequency is about 60 Hz and the second frequency is about 20 Hz.

The first region includes a moving-image display region and the second region includes a still-image display region.

DETAILED DESCRIPTION OF CERTAIN INVENTIVE EMBODIMENTS

Figure 1:
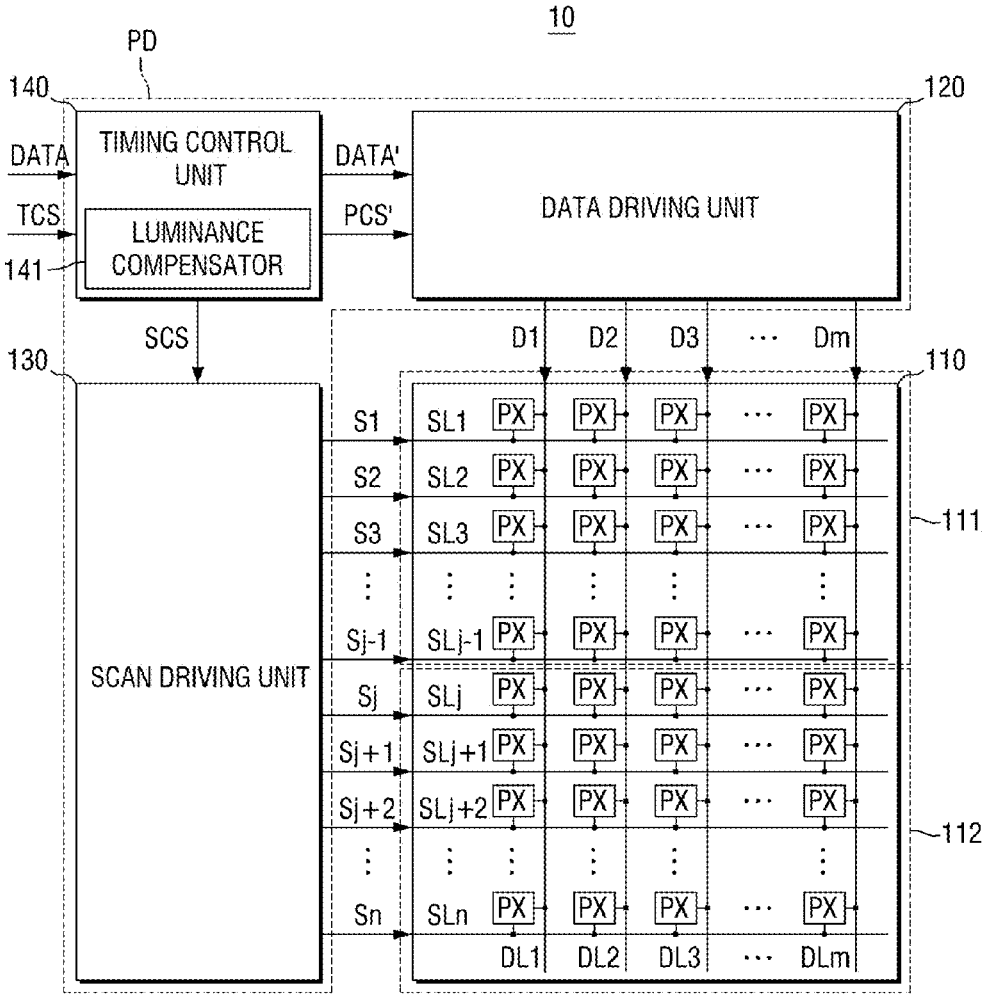
FIG. 1 is a block diagram of a display device according to an embodiment.

Low-frequency driving of display panels can result in severe discharge of data voltages stored in each pixel. This can cause severe luminance fluctuations because of the relatively long frame duration. That is, data voltages are discharged for a longer time period when displaying still-images driven at low frequencies than when displaying moving-images driven at high frequencies. Thus, the luminance of a display device varies between still and moving-image regions, which can result in a visible boundary between the regions.

The aspects and features of the described technology and methods for achieving the aspects and features will be apparent by referring to the embodiments to be described in detail with reference to the accompanying drawings. However, the described technology is not limited to the embodiments disclosed hereinafter, but can be implemented in diverse forms. The matters defined in the description, such as the detailed construction and elements of the described technology, are nothing but specific details provided to assist those of ordinary skill in the art in a comprehensive understanding of the described technology and the described technology is only defined within the scope of the appended claims.

The term "on" that is used to designate that an element is on another element or located on a different layer or a layer includes both when an element is located directly on another element or a layer and when an element is located on another element with another layer or still another element interposed therebetween. In the entire description, the same drawing reference numerals are used for the same elements across various figures.

Although the terms "first", "second", and so forth are used to describe various constituent elements, such constituent elements are not limited by these terms. These terms are used only to differentiate a constituent element from other constituent elements. Accordingly, in the following description, a first constituent element may termed be a second constituent element without departing from the scope of the described technology.

Hereinafter, embodiments will be described with reference to the attached drawings.

Figure 2:
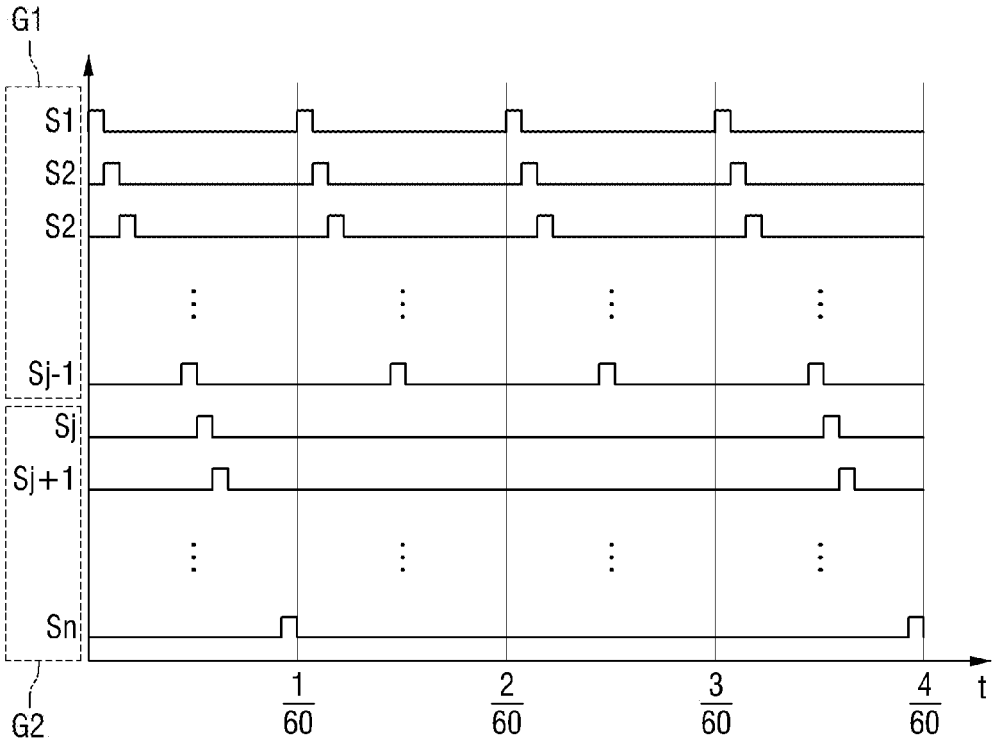
FIG. 2 is a diagram illustrating a scan signal according to an embodiment.

FIG. 1 is a block diagram of a display device according to an embodiment. FIG. 2 is a diagram illustrating a scan signal according to an embodiment.

Referring to FIG. 1, a display device 10 includes a display panel 110, a panel driver PD, and a luminance compensator 141.

Various types of display panels may be employed as the display panel 110 depending on how the display device 10 displays an image. As an example, the display panel 110 may be, but is not limited to, one of a liquid crystal display (LCD) panel, an organic light-emitting diode (OLED) panel, a plasma display panel (PDP), or an electrophoretic display (EPD) panel.

The display panel 110 includes a plurality of scan lines (SL1, SL2, . . . , SLn), a plurality of data lines (DL1, DL2, . . . , DLm), and a plurality of pixels PX. The scan lines (SL1, SL2, . . . , SLn) extend in one direction and are substantially parallel to one another. The scan lines (SL1, SL2, . . . , SLn) include first through n-th scan lines SL1 through SLn. A plurality of first through n-th scan signals S1 through Sn are respectively applied to the first through n-th scan lines SL1 through SLn. The data lines (DL1, DL2, . . . , DLm) include first through m-th data lines DL1 through DLm. The data lines DL1 to DLm intersect the scan lines SL1 to SLn. The data lines DL1 to DLm extend in a different direction from the scan lines SL1 through SLn and are substantially parallel to one another. A plurality of first through m-th data voltages D1 through Dm are respectively applied to the first through m-th data lines DL1 through DLm.

The pixels PX are arranged in a matrix, but the described technology is not limited to this. The pixels PX are respectively connected to the scan lines SL1 to SLn and the data lines DL1 to DLm. The pixels PX respectively receive the data voltages D1 to Dm from the data lines DL1 to DLm in response to the receiving the scan signals S1 to Sn from the scan lines SL1 to SLn. Each of the scan signals SL1 to SLn includes a scan-on signal Son and a scan-off signal Soff. In response to receiving the scan-on signal Son, the pixels PX respectively receive the data voltages D1 to Dm from the data lines DL1 to DLm. Similarly, in response to receiving the scan-off signal Soff, the pixels PX do not receive the data voltages D1 to Dm.

Each of the pixels PX receives one of the data voltages D1 to Dm and emits light with a grayscale level corresponding to the received data voltage. The display panel 110 includes a first region 111 which is driven at a first frequency and a second region 112 which is driven at a second frequency that is less than the first frequency. In the first region 111, the first through (j−1)-th scan lines SL1 through SLj-1 respectively receive the first through (j−1)-th scan signals S1 through Sj-1, which have the first frequency. As a result, the first through m-th data voltages D1 through Dm are received by the corresponding pixels PX. In the second region 112, the j-th through n-th scan lines SLj through SLn respectively receive the j-th through n-th scan signals Sj through Sn, which have the second frequency. In some embodiments, the first frequency and the second frequency are about 60 Hz and about 20 Hz, respectively, however the described technology is not limited thereto. In other embodiments, the first frequency is greater than about 60 Hz and the second frequency is less than about 20 Hz.

The first region 111 includes a moving-image display region and the second region 112 includes a still-image display region. That is, at least part of the first region 111 is the moving-image display region. The moving-image display region is part of the display panel 110 where different data voltages are applied in a current frame and a subsequent frame. The still-image display region is part of the display panel 110 where the same data voltages are applied in the current frame and the subsequent frame. The first region 111 in which a moving image is displayed is driven at a frequency of about 60 Hz and the second region 112 in which a still image is displayed is driven at a frequency of about 20 Hz. The frequency of about 60 Hz corresponds to a frame rate of about 60 frames per second and the frequency of about 20 Hz corresponds to a frame rate of about 20 frames per second. Accordingly, in response to the display panel 110 being driven at a frequency of about 20 Hz, the power consumption of the display panel 110 is reduced to about ⅓ compared to when the display panel 110 is driven at a frequency of about 60 Hz. That is, the power consumption of the display panel 110 is reduced by driving the display panel 110 at a low frequency during a still-image display period that does not require high-speed driving.

Due to the difference between the frequencies of the data voltages applied to the first and second regions 111 and 112, the amount of charge discharged by each pixel differs in the first and second regions 111 and 112. As a result, the pixels in each of the first and second regions 111 and 112 may have different luminance levels. Accordingly, the boundary PB between the first region 111 and the second region 112 may be visible. The luminance compensator 141 of the display device 10 compensates for the difference between the luminances of the first and second regions 111 and 112 and may prevents the boundary PB between the first and second regions 111 and 112 from being visible.

The panel driver PD includes a data driving unit or data driver 120, a scan driving unit or scan driver 130, and a timing control unit or timing controller 140. The panel driver PD can be provided separately from the display panel 110 or can be at least partially incorporated into the display panel 110.

The data driving unit 120 generates the data voltages D1 to Dm and respectively applies the data voltages D1 to Dm to the data lines DL1 through DLm. More specifically, the data driving unit 120 receives corrected image data DATA' and generates the data voltages D1 to Dm based on the corrected image data DATA'. The corrected image data DATA' is image data obtained by correcting image data DATA so as to lower the number of data voltages corresponding to the first region 111 to compensate for the difference between the luminances of the first and second regions 111 and 112.

The scan driving unit 130 respectively applies the scan signals S1 to Sn to the scan lines SL1 to SLn. The scan signals S1 to Sn can be divided into a first group G1 including one or more scan signals having the first frequency and a second group G2 including one or more scan signals having the second frequency. In a non-limiting example, the first group G1 includes the first through (j−1)-th scan signals S1 through Sj-1 and the second group G2 includes the j-th through n-th scan signals Sj through Sn, as illustrated in FIG. 2. The first frequency is about 60 Hz and the second frequency is about 20 Hz. That is, the first group G1 is scanned every 1/60 seconds to receive data voltages and the second group G2 is scanned every 1/20 seconds to receive data voltages. The scan signals included in the first group G1 are applied to the scan lines included in the first region 111, i.e., the first through (j−1)-th scan lines SL1 through SLj-1. The scan signals included in the second group G2 are applied to the scan lines included in the second region 112, i.e., the j-th through n-th scan lines SLj through SLn. The scan driving unit 130 controls one of the first and second groups G1 and G2 to have different frequencies according to a scan control signal SCS. In some embodiments, the scan driving unit 130 includes a plurality of scan drivers (not illustrated) which provide different scan signals to the different groups. In some embodiments, the scan driving unit 130 includes a first scan driver (not illustrated) applying a scan signal with a first frequency to the first through (j−1)-th scan lines SL1 through SLj-1 in the first region 111 and a second scan driver (not illustrated) applying a scan signal with a second frequency to the j-th through n-th scan lines SLj through SLn in the second region 112.

The timing control unit 140 receives the image data DATA and a control signal TCS and generates the scan control signal SCS, a data control signal DCS, and the corrected image data DATA' based on the image data DATA and the control signal TCS. The scan control signal SCS is provided to the scan driving unit 130 so as to control the scan driving unit 130. The scan control signal SCS can include a vertical synchronization signal. The data control signal DCS is provided to the data driving unit 120 so as to control the data driving unit 120. The data control signal DCS can include a horizontal synchronization signal. The corrected image data DATA' is provided to the data driving unit 120. In the FIG. 1 embodiment, the timing control unit 140 includes the luminance compensator 141, but the described technology is not limited to this. That is, the luminance compensator 141 can be provided separately from the timing control unit 140. The display device 10 will hereinafter be described in further detail with reference to FIGS. 3 to 8.

Figure 3:
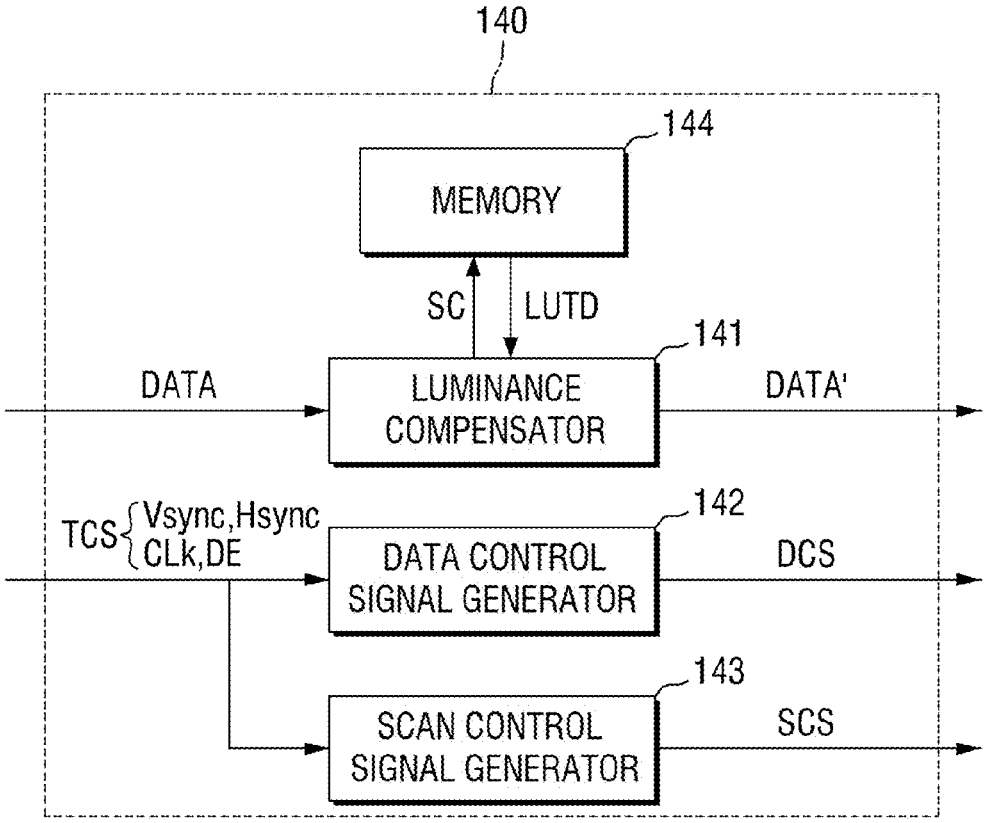
FIG. 3 is a block diagram of the timing control unit illustrated in FIG. 1.

Referring to FIG. 3, the timing control unit 140 includes the luminance compensator 141, a data control signal generator 142, a scan control signal generator 143, and a memory 144.

The luminance compensator 141 receives the image data DATA from an external source, generates the corrected image data DATA' by correcting the image data DATA such that the difference between the luminance of the first region 111 and the luminance of the second region 112 is compensated for, and outputs the corrected image data DATA' to the data driving unit 120. More specifically, the luminance compensator 141 compensates for the difference between the luminances of the first and second regions 111 and 112 by lowering the data voltages applied to the first region 111 so as to correspond to the average of the data voltages that are applied to and discharged from the second region 112 over a single frame period.

Figure 4:
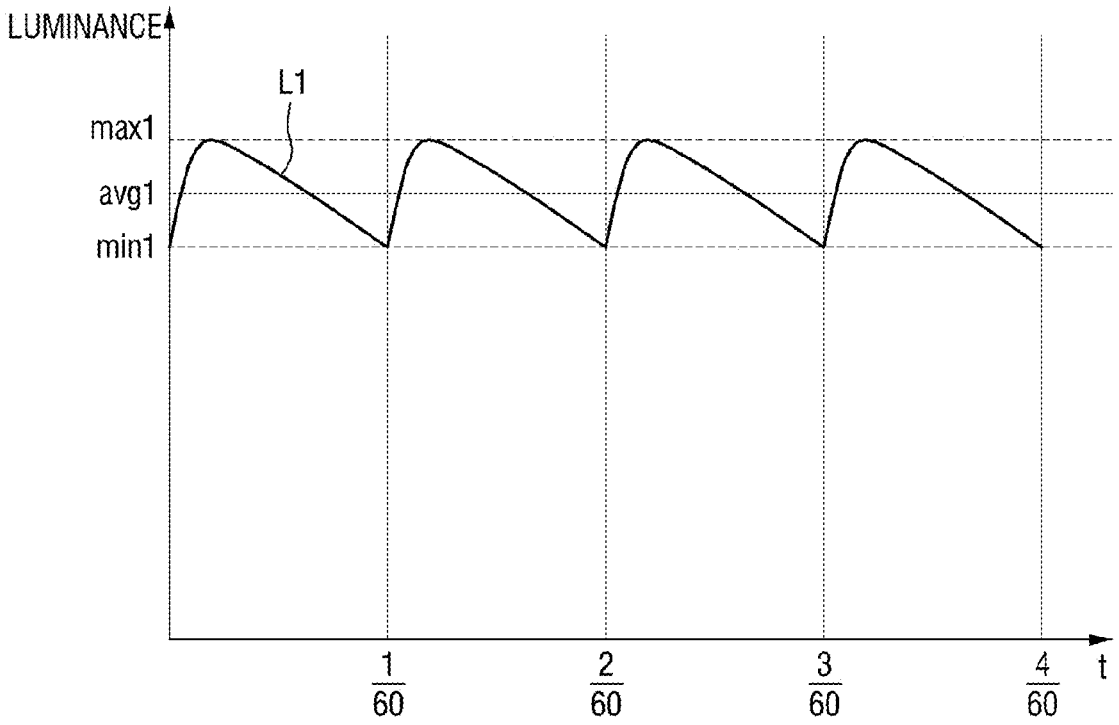
FIG. 4 is a graph showing variations in the luminance of a first region.

Referring to FIGS. 4 to 8, the first region 111 is driven at a high frequency of about 60 Hz, which corresponds to a frame length of about 1/60 seconds, and the second region 112 is driven at a low frequency of about 20 Hz, which corresponds to a frame length of about 3/60 seconds. As illustrated in FIG. 4, in response to the thin-film transistors (TFTs) of the pixels in the first region 111 being turned on by the scan signals S1 to Sj-1, each of the pixels in the first region 111 is charged with a data voltage and the luminance L1 of the pixels in the first region 111 gradually increases to a maximum level max1. In response to the TFTs of the pixels in the first region 111 being turned off, the data voltage stored in each of the pixels in the first region 111 discharges until each of the pixels in the first region 111 recharged with a data voltage for a subsequent frame. The luminance L1 reaches a minimum level min1 just prior to being recharged.

Figure 5:
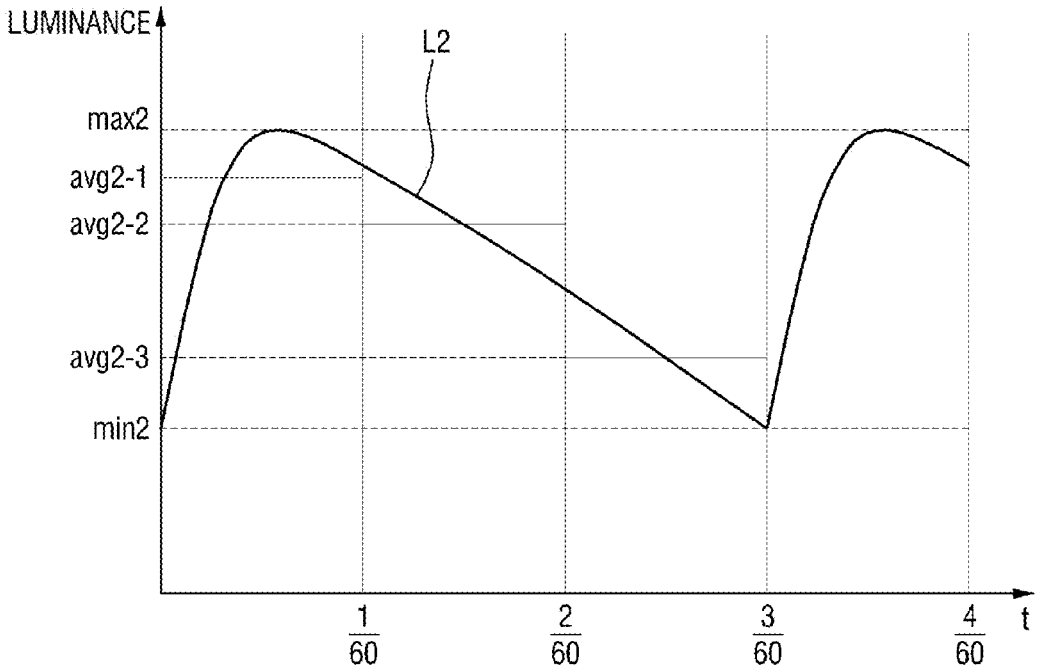
FIG. 5 is a graph showing variations in the luminance of a second region.

As illustrated in FIG. 5, in response to the TFTs of the pixels in the second region 112 being turned on by the scan signals Sj through Sn, each of the pixels in the second region 112 is charged with a data voltage and the luminance L2 of the pixels in the second region 112 gradually increases to a maximum level max2. In response to the TFTs of the pixels in the second region 112 being turned off, the data voltage stored in each of the pixels in the second region 112 discharges until each of the pixels in the second region 112 is recharged. The luminance L2 reaches a minimum level min2 just prior to being recharged.

Figure 6:
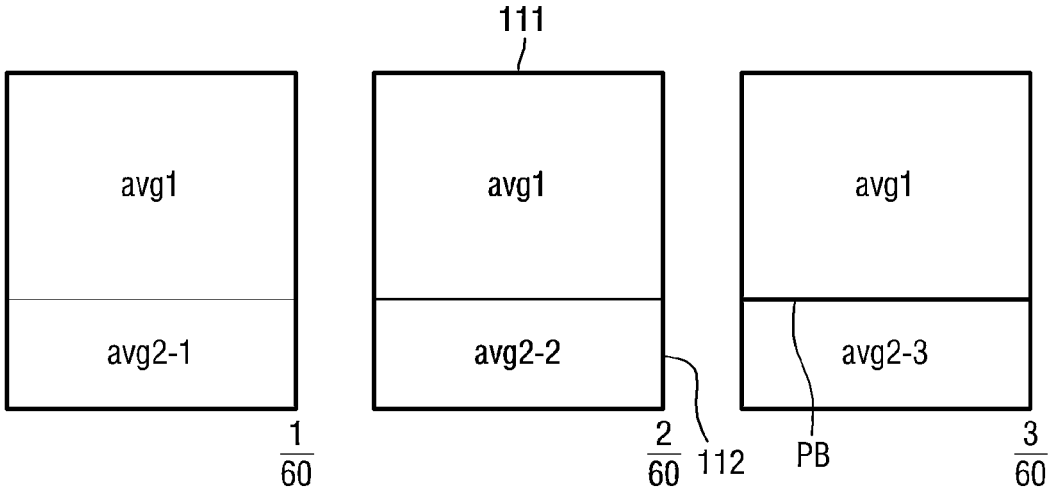
FIG. 6 is a diagram illustrating the compensation of the luminance of the first region according to the variation of the luminance of the second region.

Since the length of each frame is longer in the second region 112 than in the first region 112, the amount by which the data voltage is discharged and the variation in the luminance is greater in the second region 112 than in the first region 111. That is, the discharge of the stored data voltages continues for the pixels in the second region 112 even when the pixels in the first region 111 are recharged with a data voltage for a subsequent frame. Accordingly, as illustrated in FIG. 6, the data voltage averages avg1 in the first region 111 are initially substantially identical to the average luminance avg2-1. However, the data voltage averages avg1 gradually grow apart from the average luminance avg2-1, avg2-2, avg2-3 in the second region 112. Due to the difference between the luminances of the first and second regions 111 and 112, the boundary PB between the first region 111 and the second region 112 becomes visible. The luminance compensator 141 compensates for data voltage averages avg1, avg1' and avg" in the first region 111 so as to respectively correspond to data voltage averages avg2-1, avg2-2 and avg2-3 in the second region 112. That is, the luminance compensator 141 lowers the luminance of the first region 111 to correspond to the decrease in luminance of the second region 112.

Figure 7:
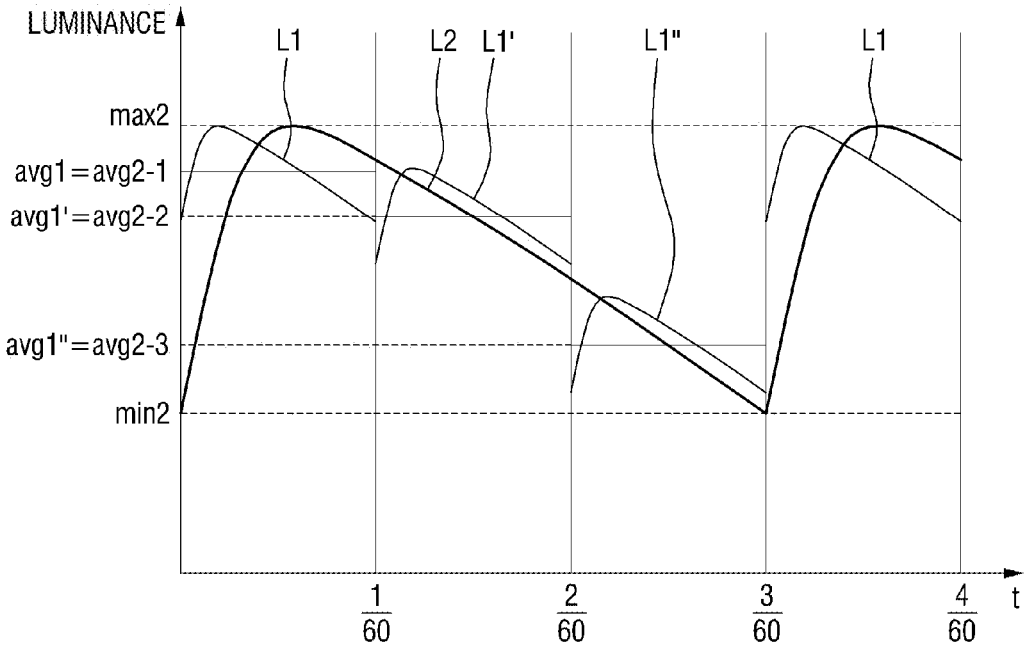
FIG. 7 is a graph showing the charge rate of each pixel of a display panel before luminance compensation.
Figure 8:
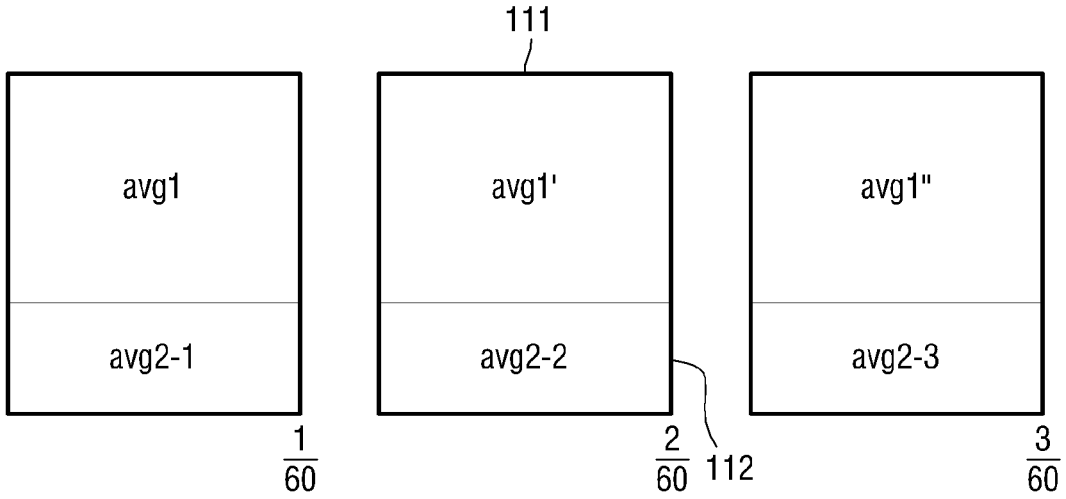
FIG. 8 is a diagram illustrating the charge rate of each pixel of a display panel after luminance compensation.

Referring to the corrected image data DATA' illustrated in FIG. 7, the data voltage average avg1' for a second frame in the first region 111 is substantially the same as the data voltage average avg2-2 in the second region 112. Similarly, the data voltage average avg1" for a third frame in the first region 111 is substantially the same as the data voltage average avg2-3 in the second region 112. The corrected image data DATA', which is provided by the luminance compensator 141, has substantially the same data voltage average in both the first region 111 and the second region 112 for a given frame. Therefore, as illustrated in FIG. 8, the boundary between the first region 111 and the second region 112 is not visible due to the compensation of luminance by the luminance compensator 141.

Referring back to FIG. 3, the memory 144 includes a plurality of lookup tables (LUTs) in which corrected image data for the first region 111 is stored in the form of matrix. The luminance compensator 141 may reads the corresponding LUT from the memory 144. More specifically, the luminance compensator 141 provides a selection signal SC to the memory 144. In response to the selection signal SC, the memory 144 provides correction image data LUTD from a LUT corresponding to the selection signal SC to the luminance compensator 141. The luminance compensator 141 corrects the image data DATA based on the correction image data LUTD, thereby obtaining the corrected image data DATA'. The luminance compensator 141 outputs the corrected image data DATA' to the data driving unit 120.

The data control signal generator 142 and the scan control signal generator receive the control signal TCS from an external source. The control signal TCS may include a vertical synchronization signal Vsync, a horizontal synchronization signal Hsync, a data enable signal DE, and a clock signal CLK.

The data control signal generator 142 generates the data control signal DCS, which is for controlling the data driving unit 120, in response to the receipt of the control signal TCS. The data control signal generator 142 outputs the data control signal DCS to the data driving unit 120. In some embodiments, the data control signal DCS includes a source start pulse SSP, a source sampling clock SSC, a source output enable signal SOE, and a polarity signal POL.

The scan control signal generator 143 generates the scan control signal SCS, which is for controlling the scan driving unit 130, in response to the receipt of the control signal TCS. The scan control signal generator 143 outputs the scan control signal SCS to the scan driving unit 130. The scan control signal SCS controls the scan driving unit 130 to sequentially generate a plurality of scan signals. The scan signals are divided into a first group G1 and a second group G2. The scan control signal SCS controls the scan signals included in the first group G1 and the scan signals included in the second group G2 to have different frequencies.

Figure 9:
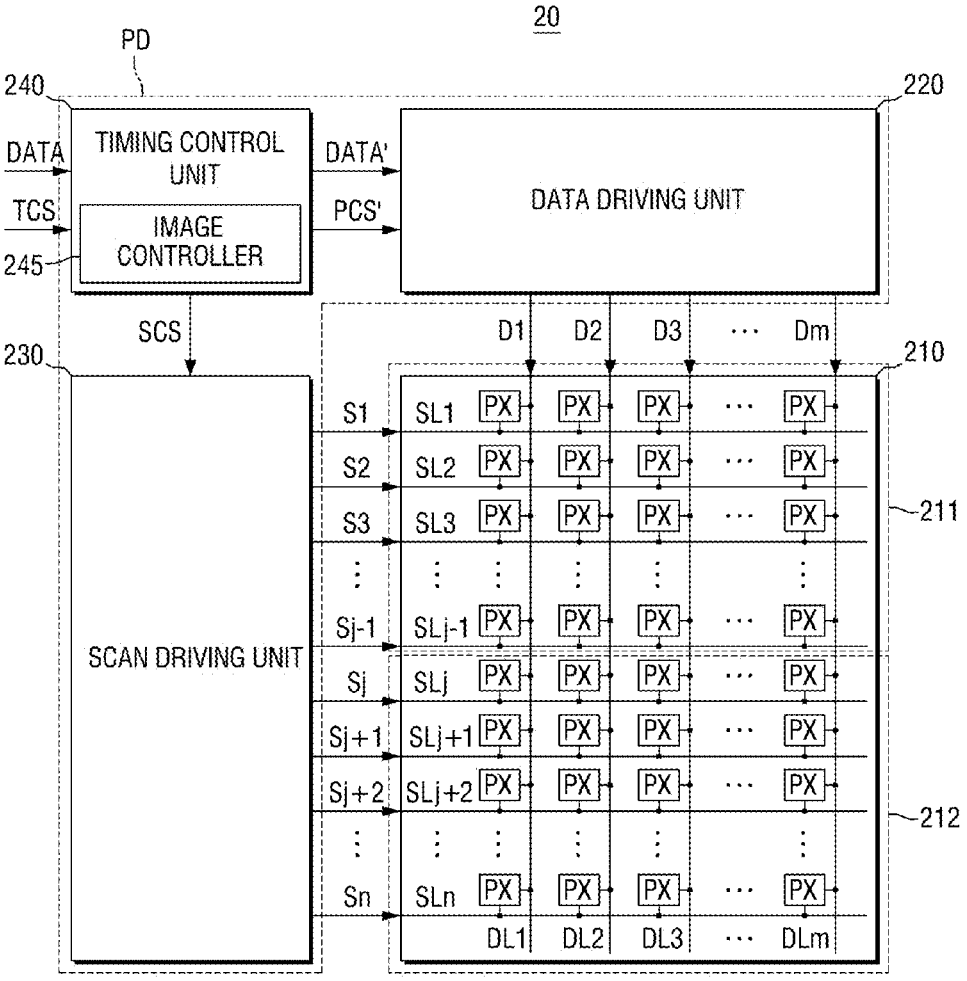
FIG. 9 is a block diagram of a display device according to another embodiment.
Figure 10:
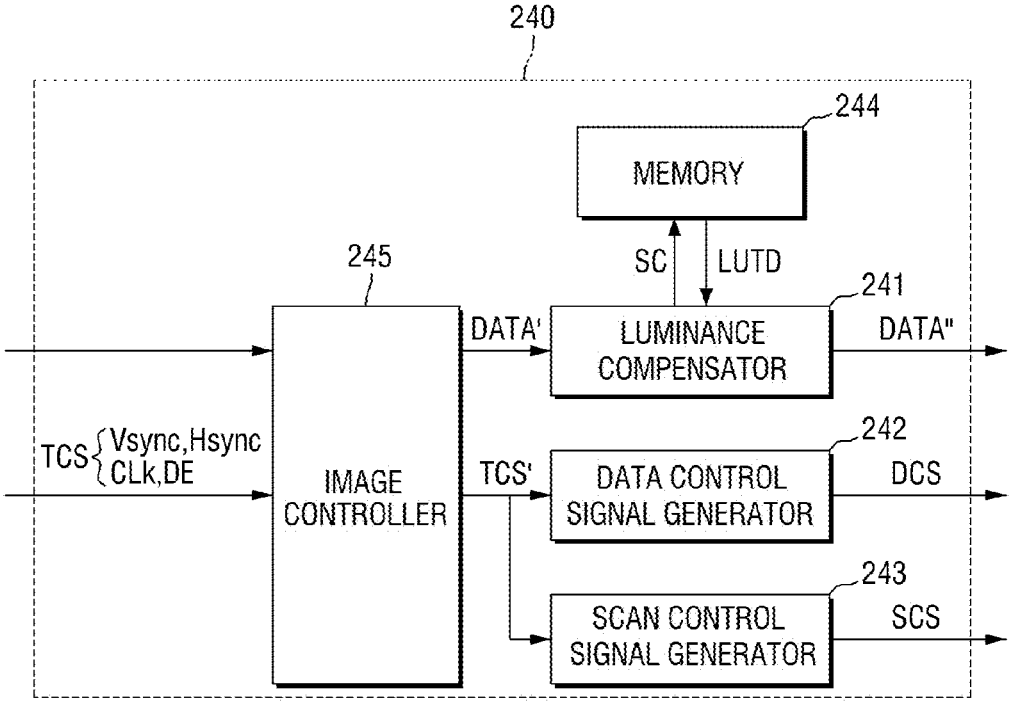
FIG. 10 is a block diagram of the timing control unit illustrated in FIG. 9.
Figure 11:
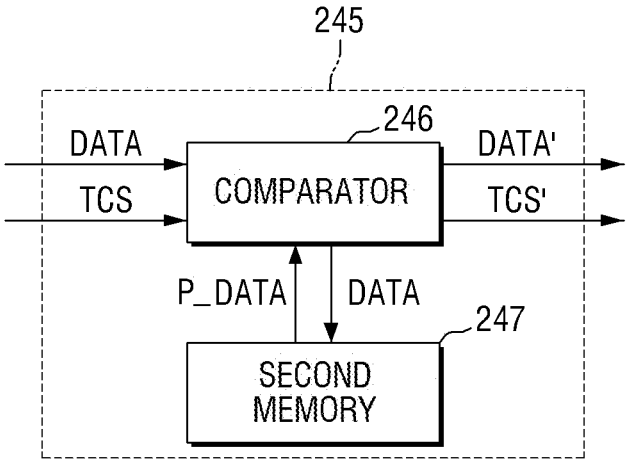
FIG. 11 is a block diagram of the image controller illustrated in FIG. 10.

A display device according to another embodiment will hereinafter be described with reference to FIGS. 9 to 11. FIG. 9 is a block diagram of a display device according to another embodiment. FIG. 10 is a block diagram of the timing control unit illustrated in FIG. 10. FIG. 11 is a block diagram of the image controller illustrated in FIG. 10.

Referring to FIGS. 9 to 11, a display device 20, in contrast to the display device 10 of FIGS. 1 to 8, further includes an image controller 245. The image controller 245 is included in a timing control unit 240, but the described technology is not limited to this. That is, the image controller 245 may be provided separately from the timing control unit 240.

The image controller 245 includes a comparator 246 and a second memory 247. The comparator 246 receives image data DATA for a current frame and a control signal TCS. The comparator 246 outputs the image data DATA to the second memory 247 and reads image data P_DATA of a previous frame from the second memory 247. The second memory 247 stores the image data DATA. The comparator 246 sets a first region 211 and a second region 212 in the display panel 210 by comparing the image data DATA to the previous image data P_DATA. The first region 211 includes a moving-image display region and the second region 212 includes a still-image display region. A region in the display panel 210 where there are no changes to the values of the image data is set as the second region 212, but the described technology is not limited to this. The comparator 246 outputs image data DATA' indicating the boundaries of the first region 211 and the second region 212 and a control signal TCS' to the luminance compensator 241, a data control signal generator 242, and a scan control signal generator 243. The luminance compensator 241 compensates for the luminance of the first region 211. The scan control signal generator 243 controls scan signals to have different frequencies to be applied to the first region 211 and the second region 212.

The display device 20 sets the first region 211 and the second region 212 in the display panel 210 by comparing the image data DATA of the current frame and the image data P_DATA of the previous frame. The display device 20 compensates for the luminance of the first region 211 so as to prevent the boundary between the first and second regions 211 and 212 from being visible.

The other elements of the display device 20 are substantially identical to their respective counterparts of the display device 10 of FIGS. 1 to 8, and thus, detailed descriptions thereof will be omitted.

Figure 12:
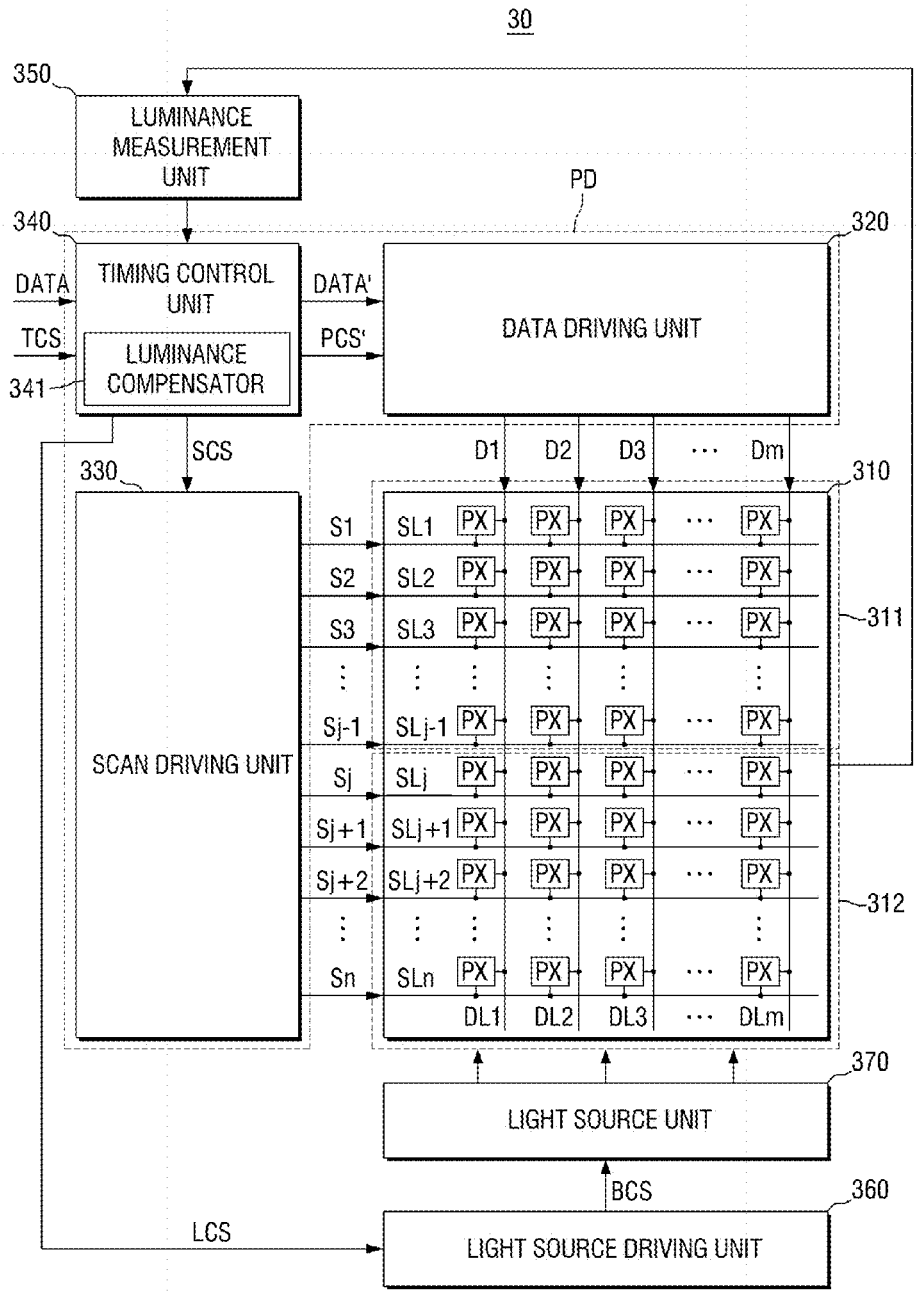
FIG. 12 is a block diagram of a display device according to another embodiment.
Figure 13:
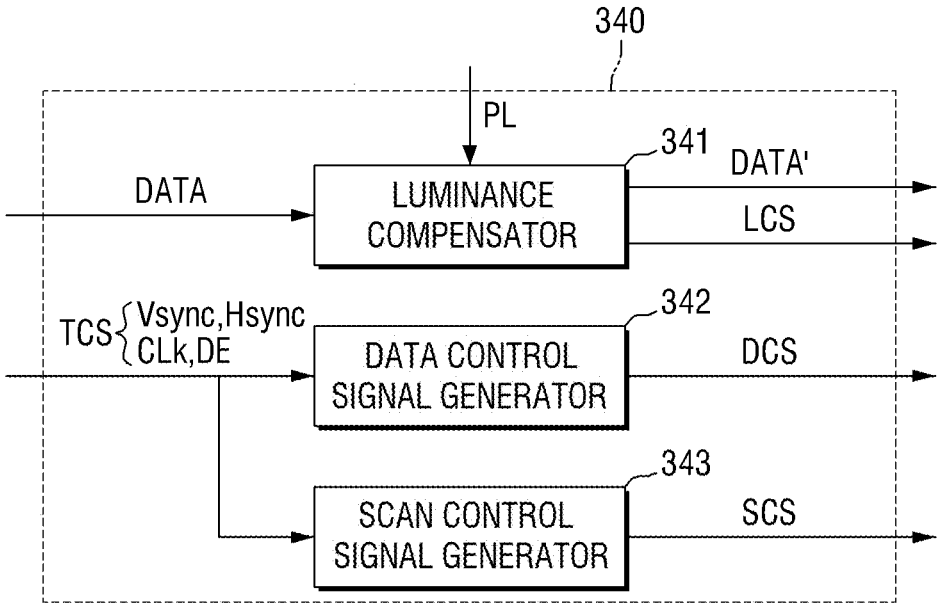
FIG. 13 is a block diagram of the timing control unit illustrated in FIG. 12.
Figure 14:
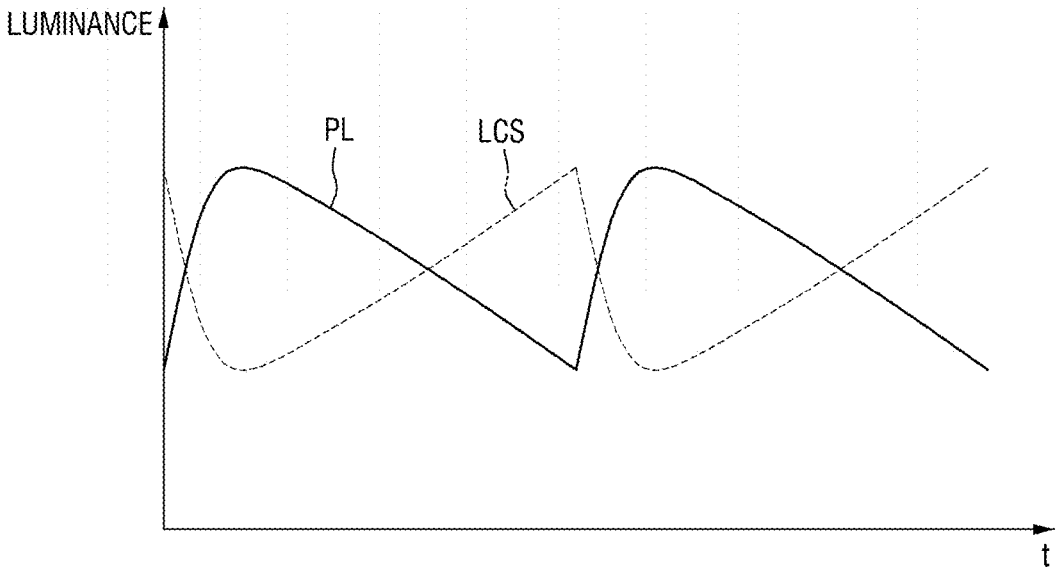
FIG. 14 is a waveform diagram illustrating a luminance signal and a light source driving signal.

A display device according to another embodiment will hereinafter be described with reference to FIGS. 12 to 14. FIG. 12 is a block diagram of a display device according to another embodiment. FIG. 13 is a block diagram of the timing control unit illustrated in FIG. 12. FIG. 14 is a waveform diagram illustrating a luminance signal and a light source driving signal.

Referring to FIG. 12, a display device 30, in contrast to the display device 10 of FIGS. 1 to 8, further includes a luminance measurement unit 350, a light source driving unit or light source driver 360, and a light source unit or light source 370. In some embodiments, the display device 30 is an LCD including a backlight unit, however the described technology is not limited thereto.

The luminance measurement unit 350 measures the luminance of a display panel 310. In some embodiments, the luminance measurement unit 350 is a photo sensor, however, the described technology is not limited thereto. The luminance measurement unit 350 converts the variation in the luminance of the display panel 310 over a single frame period into a luminance signal PL and outputs the luminance signal PL to the timing control unit 340. The luminance compensator 341 of the timing control unit 340 receives the luminance signal PL and controls data signals applied to a first region 311 and a second region 312 of the display panel 310 based on the luminance signal PL such that the first region 311 and the second region 312 may have the same luminance. In response to the receipt of the luminance signal PL, the luminance compensator 341 outputs a light source control signal LCS to the light source driving unit 360.

The light source driving unit 360 controls and drives the light source unit 370. The light source unit 370 provides light to the display panel 310, and in some embodiments, is a backlight unit. In some embodiments, the light source unit 370 includes a plurality of light sources and the light sources respectively correspond to a plurality of pixels PX of the display panel 310. The luminance of the pixels PX are adjusted by the amount of light emitted from the light sources.

The light source driving unit 360 drives the light source unit 370 according to the light source control signal LCS. Referring to FIG. 14, the waveforms of the luminance signal and the light source control signal LCS are symmetrical with respect to each other. That is, as the luminance of the luminance signal PL increases, the luminance of the light source unit 370 decreases. As the luminance of the luminance signal PL decreases, the luminance of the light source unit 370 increases. The luminance signal PL represents the luminance of the second region 312, which decreases upon the discharge of data voltages in the second region 312. The luminance compensator 341 outputs the light source control signal LCS so as to increase the luminance of part of the light source unit 370 corresponding to the second region 312 by the amount corresponding to a decrease in the luminance of the second region 312, and thus controls the boundary between the first region 311 and the second region 312 so as to not be visible.

The other elements of the display device 30 are substantially identical to their respective counterparts of the display device 10 of FIGS. 1 to 8, and thus, detailed descriptions thereof will be omitted.

Figure 15:
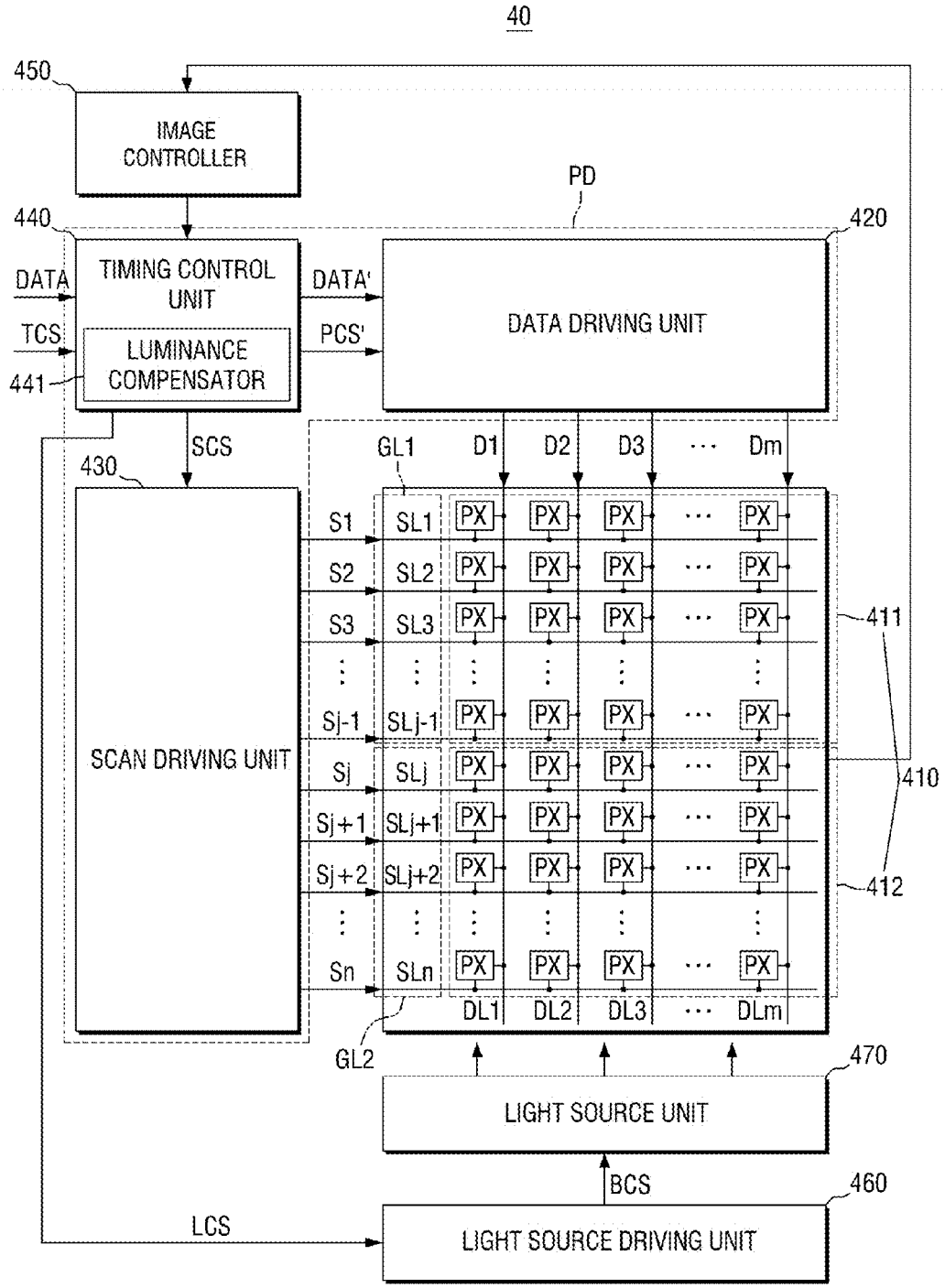
FIG. 15 is a block diagram of a display device according to another embodiment.

FIG. 15 is a block diagram of a display device according to another embodiment.

Referring to FIG. 15, a display device 40 includes a plurality of scan lines (SL1, SL2, . . . , SLn), a plurality of pixels PX, a plurality of data lines (D1, D2, . . . , DLm), a data driving unit or data driver 420, a scan driving unit or scan driver 430, a timing control unit or timing controller 440 and a luminance compensator 441.

The scan lines (SL1, SL2, . . . , SLn) extend in one direction and are substantially parallel to one another. The scan lines (SL1, SL2, . . . , SLn) include first through n-th scan lines SL1 through SLn. A plurality of first through n-th scan signals S1 through Sn are respectively applied to the first through n-th scan lines SL1 through SLn.

The data lines (DL1, DL2, . . . , DLm) include first through m-th data lines DL1 through DLm. The data lines DL1 to DLm intersect the scan lines SL1 to SLn. The data lines DL1 to DLm extend in a different direction from the scan lines SL1 to SLn and are substantially parallel to one another. A plurality of first through m-th data voltages D1 through Dm are respectively applied to the first through m-th data lines DL1 through DLm.

The pixels PX are arranged in a matrix, but the described technology is not limited to this. The pixels PX are respectively connected to the scan lines SL1 to SLn and the data lines DL1 to DLm. The pixels PX respectively receive the data voltages D1 to Dm from the first data lines DL1 to DLm in response to receiving the scan signals S1 to Sn from the scan lines SL1 to SLn. Each of the scan signals SL1 to SLn includes a scan-on signal Son and a scan-off signal Soff. In response to the receipt of the scan-on signal Son, the pixels PX respectively receive the data voltages D1 to Dm from the data lines DL1 to DLm. Alternatively, in response to the receipt of the scan-off signal Soff, the pixels PX do not receive the data voltages D1 to Dm. Each of the pixels PX receives a corresponding data voltage D1 to Dm and emits light with a corresponding a grayscale level.

The data driving unit 420 respectively provides the data voltages D1 to Dm to the data lines DL1 through DLm.

The scan driving unit 430 respectively provides the scan signals S1 to Sn to the scan lines SL1 through SLn.

The scan lines SL1 to SLn include a first scan line group GL1 to which scan signals having a first frequency are applied and a seconds scan line group GL2 to which scan signals having a second frequency are applied, wherein the second frequency is different from the first frequency. The pixels PX include a first pixel group 411 connected to the first scan line group GL1 and a second pixel group 412 connected to the second scan line group GL2. The first frequency and the second frequency may be, but are not limited to, about 60 Hz and about 20 Hz, respectively. That is, the pixels included in the first pixel group 411 are driven at a high frequency of about 60 Hz or greater and the pixels included in the second pixel group 412 are driven at a low frequency of about 20 Hz or less. The pixels included in the first pixel group 411 display a moving image and the pixels included in the second pixel group 412 display a still image. That is, the power consumption of the display device 40 can be reduced by driving the first pixel group 411, which displays a moving image, at a high frequency and driving the second pixel group 412, which displays a still image, at a low frequency.

Due to the difference between the frequencies applied to the first and second pixel groups 411 and 412, the first and second pixel groups 411 and 412 may differ from each other in terms of the amount of discharge from a data voltage charged in each pixel. As a result, the pixel groups may have different luminance levels. Accordingly, a boundary PB between the first and second pixel groups 411 and 412 may become visible. The luminance compensator 441 of the display device 40 compensates for the difference between the luminance of the first and second pixel groups 411 and 412. The luminance compensator 441 lowers the average of data voltages applied to the first pixel group 411 over a single frame period such that the first pixel group 411 has substantially the same data voltage average as the second pixel group 412 over the single frame period. Accordingly, the boundary PB between the first pixel group 411 and the second pixel group 412 can be prevented from being visible.

In some embodiments, the display device 40 also includes a light source unit or light source 470 which provides a source of light to the pixels PX. The luminance compensator 441 increases the luminance of part of the light source unit 470 corresponding to the second pixel group 412 by an amount corresponding to the decrease in the luminance of the second pixel group 412, and thus prevents the boundary PB between the first and second pixel groups 411 and 412 from being visible.

In some embodiments, the display device 40 also includes an image controller 450 which sets the boundaries of the first pixel group 441 and the second pixel group 442 by comparing image data DATA of a current frame and image data P_DATA of a previous frame. That is, the first pixel group 441, which displays moving images, and the second pixel group 442, which displays a still image, may be set by the image controller 450. In this example, the boundary PB between the first and second pixel groups 411 and 412 can be prevented from being visible by compensating for the difference between the luminances of the first and second pixel groups 411 and 412.

The other elements of the display device 40 are substantially identical to their respective counterparts of the display device 10 of FIGS. 1 to 8, and thus, detailed descriptions thereof will be omitted.

A method of driving a display device, according to an embodiment will hereinafter be described.

Figure 16:
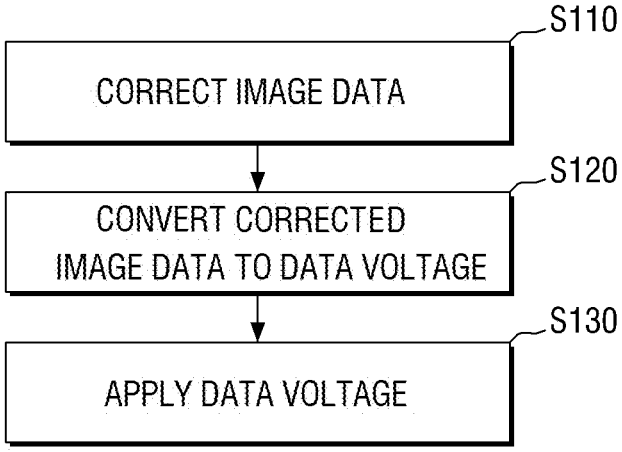
FIG. 16 is a flowchart illustrating a method of driving a display device according to an embodiment.

FIG. 16 is a flowchart illustrating a method of driving a display device, according to an embodiment.

Referring to FIG. 16, the method includes correcting image data (S110), converting the corrected image data into a data voltage (S120), and applying the data voltage (S130). The method will hereinafter be described in further detail with reference to FIG. 1.

First, image data is corrected (S110).

More specifically, image data DATA is corrected by the luminance compensator 141 of the timing control unit 140. That is, the luminance compensator 141 corrects the image data DATA to compensate for the difference between the luminances of the first region 111, which is driven at a first frequency, and the second region 112, which is driven at a second frequency that is different from the first frequency. The first frequency is a high frequency and the second frequency is a low frequency. In some embodiments, the first frequency and the second frequency may be, but are not limited to, about 60 Hz and about 20 Hz, respectively.

The first region 111 is one part of the display panel 110 to which a scan signal with the first frequency is applied and the second region 112 is another part of the display panel 110 to which a scan signal with the second frequency is applied. The first region 111 includes a moving-image display region and the second region 112 includes a still-image display region. Due to the difference between the frequencies applied to the first and second regions 111 and 112, the first and second regions 111 and 112 differ from each other in terms of the amount of discharge from a data voltage charged in each pixel. As a result, the first and second regions 111 and 112 have different luminance levels. Accordingly, the boundary PB between the first and second regions 111 and 112 may become visible. The luminance compensator 141 compensates for the difference between the luminances of the first and second regions 111 and 112. More specifically, the luminance compensator 141 lowers the average of data voltages applied to the first region 111 over a single frame period such that the first region 111 has substantially the same data voltage average as the second region 112 for the single frame period. Accordingly, the boundary PB between the first region 111 and the second region 112 can be prevented from being visible.

The memory 144 includes a plurality of LUTs in which correction image data LUTD for the first region 111 is stored in the form of a matrix. The luminance compensator 141 reads an LUT corresponding to the image data DATA from the memory 144. More specifically, the luminance compensator 141 provides a selection signal SC to the memory 144 and in response to the selection signal SC, the memory 144 provides correction image data LUTD from an LUT corresponding to the selection signal SC to the luminance compensator 141. The luminance compensator 141 corrects the image data DATA based on the correction image data LUTD, thereby obtaining the corrected image data DATA'. The luminance compensator 141 outputs the corrected image data DATA' to the data driving unit 120.

Next, the corrected image data is converted into a data voltage (S120).

More specifically, the data driving unit 120 receives the corrected image data DATA' and the data control signal DCS from the timing control unit 140. The data driving unit 120 also receives a gamma voltage from a gamma voltage generation unit (not illustrated). The data driving unit 120 converts the corrected image data DATA', which is digital data, into an analog data voltage by using the gamma voltage. That is, the data driving unit 120 converts the corrected image data DATA' into a data voltage by using, for example, linear interpolation.

The data voltage obtained from the corrected image data is applied to a display panel (S130).

More specifically, the data driving unit 120 includes a buffer (not illustrated). The data voltage obtained from the corrected image data DATA' is applied to the buffer. The buffer buffers the data voltage obtained from the corrected image data DATA' and outputs the buffered data voltage to each data line of the display panel 110.

The other steps or processes of the method of FIG. 16 are substantially identical to the descriptions of the corresponding elements of the display device 10 of FIGS. 1 to 8, and thus, detailed descriptions thereof will be omitted.

Although embodiments have been described with reference to a number of illustrative embodiments, it should be understood that numerous other modifications and embodiments can be devised by those skilled in the art that will fall within the spirit and scope of the invention. More particularly, various modifications are possible to the component parts and/or arrangements within the scope of the invention. In addition to variations and modifications in the component parts and/or arrangements, alternative uses will also be apparent to those skilled in the art.

What is claimed is:

1. A display device, comprising:

a display panel comprising a first region including a first plurality of pixels and a second region including a second plurality of pixels, wherein the first region is configured to display a first image having a first luminance and wherein the second region is configured to display a second image having a second luminance, wherein the first image is a moving-image and the second image is a still-image;

a panel driver configured to drive the first region at a first frequency and the second region at a second frequency less than the first frequency, wherein the panel driver is configured to respectively apply first and second data voltages to the first plurality of pixels of the first region and the second plurality of pixels of the second region, respectively, wherein the second data voltages are configured to be discharged over time; and a luminance compensator configured to compensate for the difference between the first and second luminance, wherein the luminance compensator is configured to reduce the first data voltages applied to the first plurality of pixels over a single frame period of the second frequency such that the average of the first data voltages is substantially the same as the average of the second data voltages and such that the first data voltages correspond to the average of the discharge of the second data voltages.

2. The display device of claim 1, further comprising a memory storing a plurality of lookup tables (LUTs) comprising correction data for the first region.

3. The display device of claim 1, further comprising a luminance measurement unit configured to measure luminance of the display panel and output a luminance signal corresponding to the measured luminance to the luminance compensator, wherein the luminance compensator is further configured to compensate for the difference in the luminances based at least in part on the luminance signal.

4. The display device of claim 3, further comprising:

a light source configured to provide light to the display panel; and a light source driver configured to control the light source, wherein the luminance compensator is further configured to provide a light source control signal to the light source driver, wherein the waveform of the light source control signal is substantially symmetrical with respect to the waveform of the luminance signal, and wherein the light source driver is further configured to drive the light source based at least in part on the light source control signal.

5. The display device of claim 1, further comprising an image controller configured to:

receive present frame image data and previous frame image data;

compare the present frame image data to the previous frame image data; and set the first region and the second region in the display panel based at least in part on the comparison.

6. The display device of claim 1, wherein the first frequency is about 60 Hz and the second frequency is about 20 Hz.

7. A display device, comprising:

a plurality of pixels comprising a first pixel group and a second pixel group, wherein the first pixel group is configured to display a first image having a first luminance and wherein the second pixel group is configured to display a second image having a second luminance, wherein at least one of the pixels in the first pixel group is configured to display a moving-image and wherein at least one of the pixels in the second pixel group is configured to display a still-image;

a plurality of scan lines electrically connected to the pixels;

a plurality of data lines crossing the scan lines and electrically connected to the pixels;

a scan driver configured to respectively apply a plurality of scan signals to the scan lines and drive the first pixel group at a first frequency and the second pixel group at a second frequency;

a data driver configured to respectively apply a plurality of data voltages to the data lines and to respectively apply first and second data voltages to the first and second pixel groups, respectively, wherein the pixels of the second pixel group are configured to discharge over time; and a luminance compensator configured to compensate for the difference between the first and second luminances and to lower one or more of the first data voltages applied to the first pixel group over a single frame period of the second frequency such that the average of the first data voltages is substantially the same as the average of the second data voltages applied to the second pixel group and the first data voltages correspond to the average of the discharge of the second data voltages applied to the second pixel group.

8. The display device of claim 7, further comprising a light source configured to provide light to the pixels, wherein the luminance compensator is further configured to increase luminance of the light source based at least in part on a decrease in the second luminance.

9. The display device of claim 7, wherein the first frequency is about 60 Hz and the second frequency is about 20 Hz.

10. The display device of claim 7, further comprising an image controller configured to:

receive present frame image data and previous frame image data;

compare the present frame image data to the previous frame image data; and set the first pixel group and the second pixel group based at least in part on the comparison.

11. A method of driving a display device comprising a display panel including a first region and a second region, the method comprising:

displaying a first image having a first luminance in the first region including a first plurality of pixels, wherein the first image is a moving-image;

displaying a second image having a second luminance in the second region, including a second plurality of pixels, wherein the second image is a still-image;

driving the first region at a first frequency and the second region at a second frequency, wherein the pixels of the second plurality of pixels are configured to discharge over time;

compensating image data for the difference between the first and second luminances, the compensating comprises lowering one or more first data voltages to be applied to the first plurality of pixels over a single frame period of the second frequency such that the average of the first data voltages is substantially the same as the average of one or more second data voltages and the first data voltages correspond to the average of the discharge of the second data voltages applied to the second plurality of pixels;

converting the compensated image data into the first and second data voltages; and applying the first and second data voltages to the first and second plurality of pixels of the display panel, respectively.

12. The method of claim 11, wherein the display device further comprises a light source, wherein the method further comprises the light source providing light to the display panel, and wherein the compensating comprises increasing luminance of the light source based at least in part on a decrease in the luminance of the second region.

13. The method of claim 11, wherein the first frequency is about 60 Hz and the second frequency is about 20 Hz.

* * * * *